US008733585B2

(12) United States Patent
Abdi et al.

(10) Patent No.: US 8,733,585 B2
(45) Date of Patent: May 27, 2014

(54) FOLDING CONTAINER LID

(75) Inventors: Abraham Abdi, Newport Coast, CA (US); Katina C. Brown, Lake Elsinore, CA (US); Sadollah Vahidy, Riverside, CA (US); Robert J. Schaefer, Hemet, CA (US)

(73) Assignee: Merrick Engineering, Inc., Corona, CA (US)

( * ) Notice: Subject to any disclaimer, the term of this patent is extended or adjusted under 35 U.S.C. 154(b) by 0 days.

(21) Appl. No.: 13/517,845

(22) Filed: Jun. 14, 2012

(65) Prior Publication Data

US 2013/0334241 A1 Dec. 19, 2013

(51) Int. Cl.

| | |
|---|---|
| ***B65D 43/08*** | (2006.01) |
| ***B65D 25/28*** | (2006.01) |
| ***B65D 43/02*** | (2006.01) |
| *B65D 25/32* | (2006.01) |

(52) U.S. Cl.

CPC ..... *B65D 43/0212* (2013.01); *B65D 43/0204* (2013.01); *B65D 25/325* (2013.01); *B65D 2251/10* (2013.01)

USPC ..... 220/826; 220/769; 220/254.6

(58) Field of Classification Search

CPC ..... B65D 43/0204; B65D 43/0212; B65D 43/08; B65D 2251/10; B65D 25/325; B65D 25/32; B65D 51/18; B65D 51/04

USPC ..... 220/826, 810, 254.6, 254.3, 254.1, 220/259.1, 256.1, 525, 524, 523, 212.5, 220/212, 769

IPC ..... B65D 25/28

See application file for complete search history.

(56) References Cited

U.S. PATENT DOCUMENTS

| | | | | | |
|---|---|---|---|---|---|
| 520,505 | A | * | 5/1894 | Upton | 222/111 |
| 621,559 | A | * | 3/1899 | Ebert | 209/417 |
| 950,844 | A | * | 3/1910 | Dolan | 220/524 |
| 1,080,551 | A | * | 12/1913 | Hartwell | 43/55 |
| 1,408,387 | A | * | 2/1922 | Nichols et al. | 220/826 |
| 1,448,316 | A | * | 3/1923 | Shackitt | 220/622 |
| 2,242,421 | A | * | 5/1941 | Dodge | 220/215 |
| 4,143,695 | A | * | 3/1979 | Hoehn | 220/826 |
| 4,369,901 | A | * | 1/1983 | Hidding | 222/480 |
| 4,723,693 | A | * | 2/1988 | DeCoster | 222/483 |
| D351,704 | S | | 10/1994 | Breen | |
| D381,162 | S | | 7/1997 | Berend et al. | |
| 5,971,231 | A | * | 10/1999 | Samz et al. | 222/480 |
| D419,829 | S | | 2/2000 | Wilson et al. | |

(Continued)

OTHER PUBLICATIONS

Translucent Plastic Round Tubs, at least as early as Jun. 12, 2011.

(Continued)

*Primary Examiner* — Robert J Hicks

(74) *Attorney, Agent, or Firm* — Knobbe, Martens, Olson & Bear LLP

(57) ABSTRACT

A lid can be configured to removably attach to a container. The lid can include multiple lid portions can open independently of each other. A first lid portion can open while a second lid portion remains closed and coupled to the container. Similarly, the second lid portion can open while the first lid portion remains closed and coupled to the container. A junction can joint the first and second lid portions and can enable pivoting of the lid so that the first and second lid portions can hingedly move with respect to each other.

23 Claims, 6 Drawing Sheets

(56) References Cited

U.S. PATENT DOCUMENTS

| | | | | |
|---|---|---|---|---|
| D439,022 | S | 3/2001 | Brandeis | |
| D634,908 | S | 3/2011 | Lortscher | |
| D649,726 | S | 11/2011 | Manuel | |
| 2006/0124643 | A1 * | 6/2006 | Markert et al. | 220/254.3 |

OTHER PUBLICATIONS 3.5 Gallon EZ Store Buckets, dated Dec. 22, 2010.
Pailking, 3 pages, dated Jul. 22, 2011.
PailKing, 2 pages, dated Jun. 13, 2010.

* cited by examiner

FOLDING CONTAINER LID

BACKGROUND

1. Field of the Disclosure

This disclosure relates to container lids, and more specifically to lids having multiple openable portions.

2. Description of the Related Art

Various types of containers and lids are available. However, available containers and lids suffer from various drawbacks. In some cases, a lid can either be secured to the container to fully close the container or be completely removed from the container to open the container. These lids do not allow the container to be partially opened, and can allow the lid to be misplaced when separated from the container. Some lids allow partial opening of a container, but provide access to the container from only one location or direction or only open a small area of the container. Some of the embodiments disclosed herein overcome one or more of the disadvantages mentioned above.

SUMMARY OF CERTAIN EMBODIMENTS

Some embodiments disclosed herein relate to a lid for use with a container having an opening. The lid can include a first lid portion configured to releasably attach to a first region of the container to cover a first portion of the opening, a second lid portion configured to releasably attach to a second region of the container to cover a second portion of the opening, and a junction joining the first lid portion and the second lid portion. The lid can be configured to pivot (e.g., hinge or fold) at the junction. The first lid portion can be configured to remain closed on the first region of the container when the second lid portion is open. The second lid portion can be configured to remain closed on the second region of the container when the first lid portion is open.

In some embodiments, the junction can extend generally across a central region of the lid. In some embodiments, the junction can intersect a point substantially at the center of the lid. The first lid portion and the second lid portion can be substantially symmetrical. The junction can include a groove configured to facilitate pivoting of the lid at the junction, and the groove can be on an underside of the lid.

The first lid portion, the second lid portion, and the junction can be integrally formed as a single piece. The first lid portion and the second lid portion can be integrally formed as a single piece.

The lid can be configured to prop or otherwise maintain at least one of the first and second lid portions open at an angle of at least about 90° and/or less than or equal to about 150°. The lid can be configured to prop or otherwise maintain at least one of the first and second lid portions open at an angle of about 120°.

The lid can include one or more recesses in a periphery of the lid, and the recesses can be configured to generally align with one or more handles of the container when the lid is attached to the container such that the one or more handles can pass through the one or more recesses. A first recess can be positioned at a first end of the junction and a second recess can be positioned at a second end of the junction, and the recesses can facilitate pivoting of the lid at the junction.

The lid can include an engagement wall configured to engage a portion of the container to releasably attach the lid to the container, and the engagement wall can include one or more slits configured to facilitate pivoting of the lid at the junction.

Some embodiments disclosed herein relate to a method of making a lid for use with a container having an opening. The method can include forming a first lid portion configured to releasably attach to a first region of the container to cover a first portion of the opening, forming a second lid portion configured to releasably attach to a second region of the container to cover a second portion of the opening, and forming a junction joining the first lid portion and the second lid portion, such that the lid is configured to pivot (e.g., hinge or fold) at the junction. The first lid portion can be configured to remain closed on the first region of the container when the second lid portion is open. The second lid portion can be configured to remain closed on the second region of the container when the first lid portion is open.

The method can include forming the junction to extend generally across a central region of the lid. The method can include forming the first and second lid portions to be substantially symmetrical to each other. Forming the junction can include forming a groove (e.g., on an underside of the lid), and the groove can be configured to facilitate pivoting of the lid.

The method can include forming a first recess in a periphery of the lid at a first end of the junction, and forming a second recess in the periphery of the lid at a second end of the junction. The first and second recesses can be configured to facilitate pivoting of the lid at the junction. The first and second recesses are configured to generally align with first and second handles of the container when the lid is attached to the container such that the first and second handles pass through the first and second recesses.

The method can include forming an engagement wall configured to engage a portion of the container to releasably attach the lid to the container, and forming at least one slit in the engagement wall such that the one or more slits facilitate pivoting of the lid at the junction.

BRIEF DESCRIPTION OF THE DRAWINGS

Certain embodiments will be discussed in detail with reference to the following figures. These figures are provided for illustrative purposes only, and the inventions are not limited to the subject matter illustrated in the figures.

DETAILED DESCRIPTION OF CERTAIN EMBODIMENTS

Figure 1:
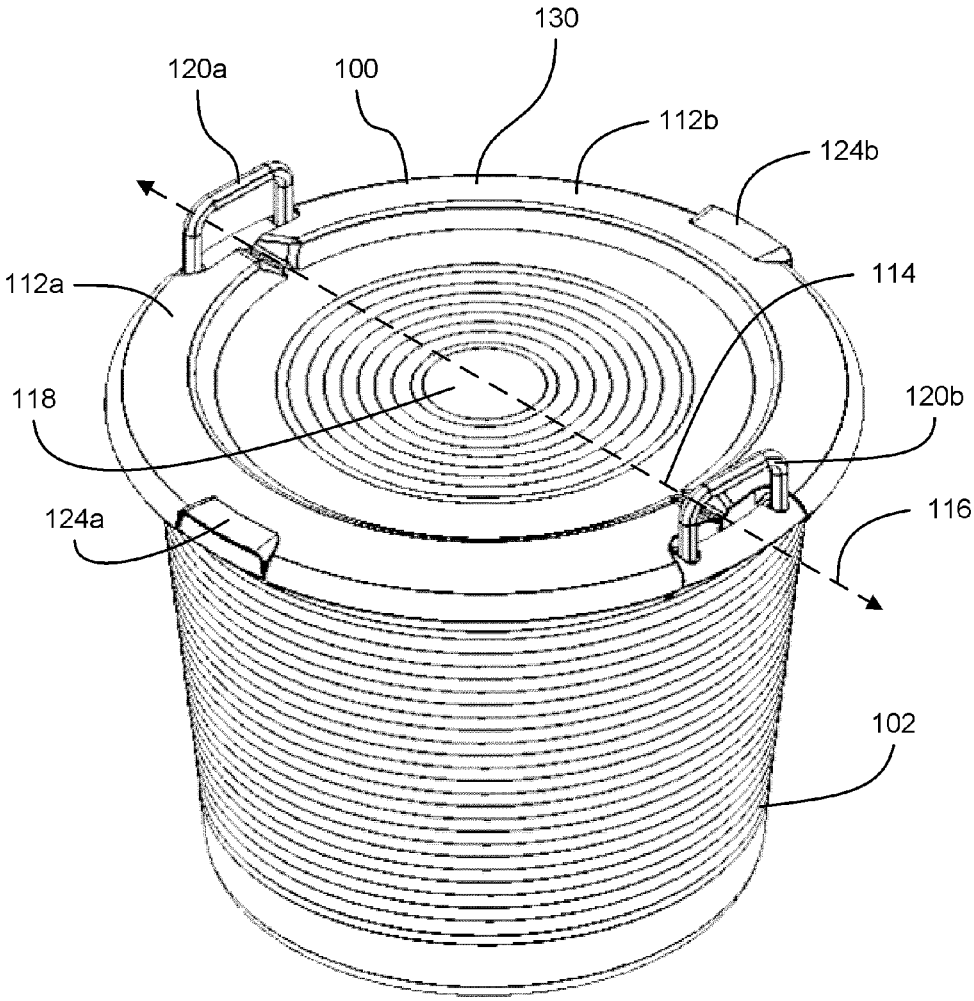
FIG. 1 is a perspective view of an example embodiment of a lid attached to a container.
Figure 2:
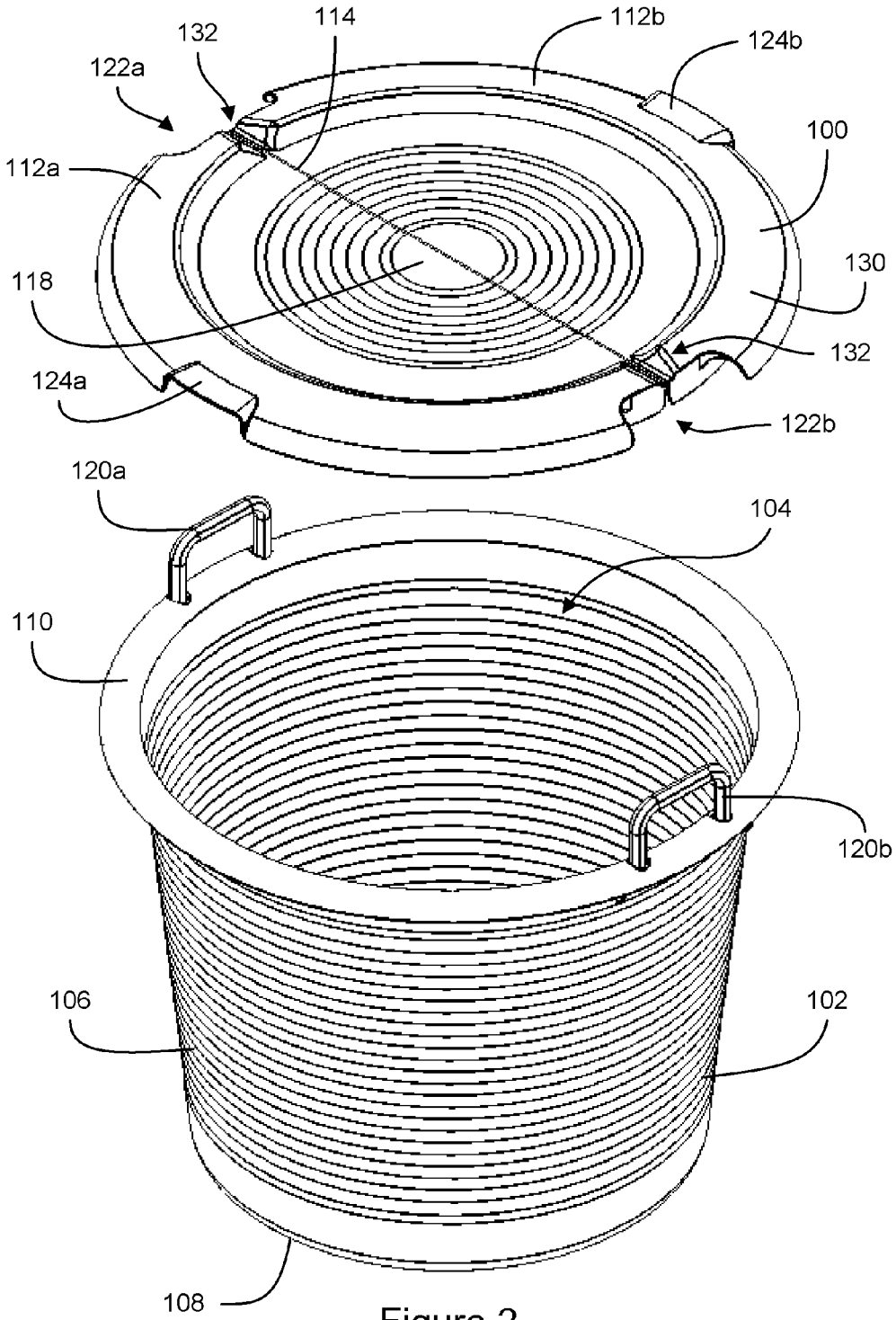
FIG. 2 is an exploded perspective view of the lid and container of FIG. 1.

FIG. 1 is a perspective view of an example embodiment of a lid 100 attached to a container 102. FIG. 2 is an exploded perspective view of the lid 100 and container 102 of FIG. 1. The container 102 can be, for example, a bin, a tub, a bucket, a box, or other structure having an opening 104 to provide access to a recess provided therein. The container 102 can include side walls 106 and a base 108. The base 108 can be positioned generally opposite the opening 104 such that the side walls 106 extend between the base 108 and the opening 104. The container 102 can be generally cylindrical in shape, as shown in FIGS. 1 and 2, although various other shapes can also be used (e.g., the shape generally of a cube or cuboid). The side walls 106 can be ribbed, as shown in FIGS. 1 and 2, or the side walls 106 can be generally smooth. The side walls 106 can be curved, such as to form the generally cylindrical shape shown, or the side walls 106 can be straight (e.g., meeting at angles to form the general shape of a cube, cuboid, or other suitable shape). A rim 110 can surround all or a portion of the opening 104. The rim 110 can be configured to engage the lid 102 for closing the all or part of the opening 104.

Figure 3:
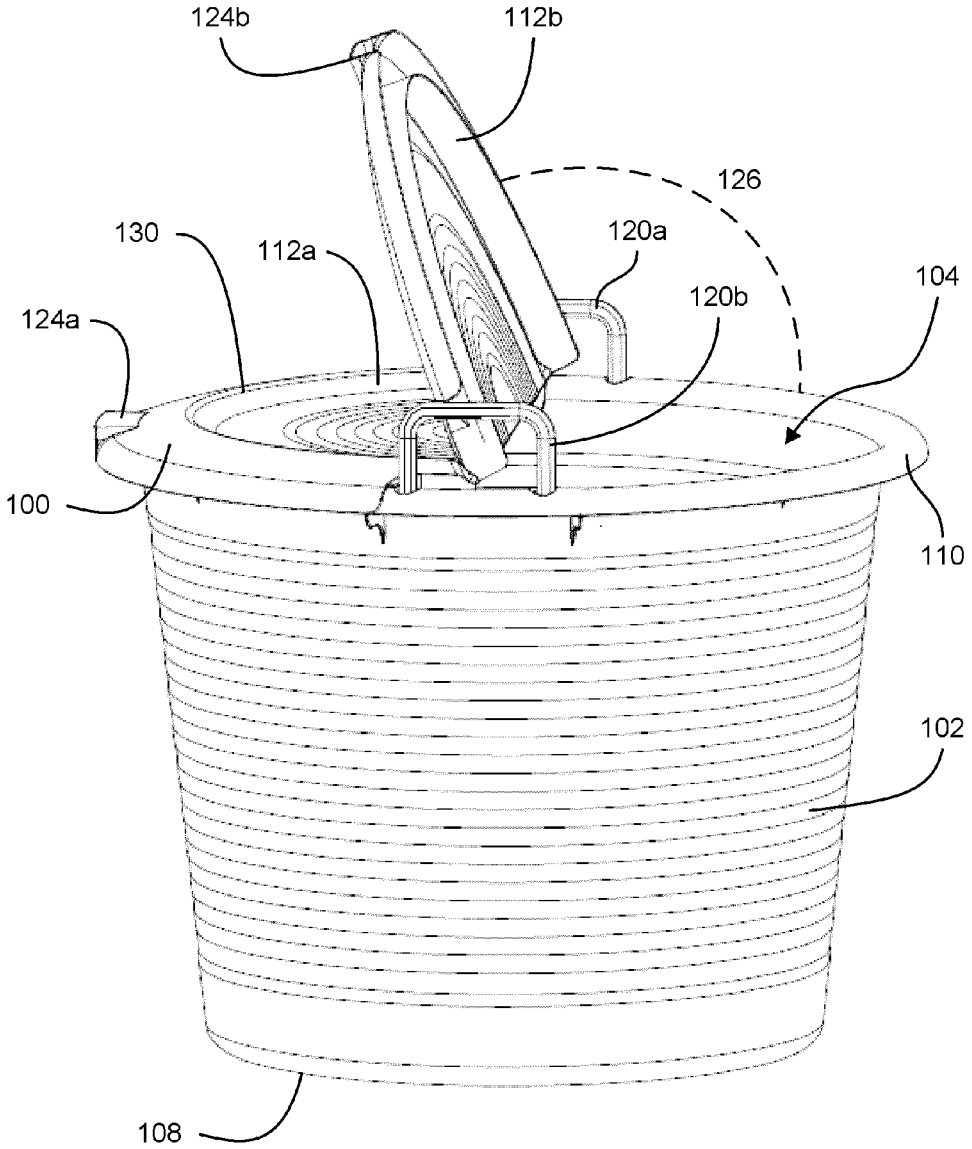
FIG. 3 is a side perspective view of the container and lid with one lid portion in an open configuration.

The lid 100 can include a plurality of lid portions, one or more of which can be configured to open independent of the other lid portions. Thus, one or more lid portions can remain closed (e.g., attached to the container 102), while one or more other lid portions are opened (e.g., detached from the container 102). As shown in FIGS. 1 and 2, the lid 100 can include a first lid portion 112*a* and a second lid portion 112*b*, which can both be configured to disengage from the container 102 to open first and second corresponding portions or sides of the opening 104. As shown in FIG. 3, the first lid portion 112*a* can remain closed (e.g., attached to the container 102) while the second lid portion 112*b* is open (e.g., detached from the container 102). In some embodiments, the second lid portion 112*b* can remain closed while the first lid portion 112*a* is open (not shown). Thus, the lid 100 can allow different portions of the opening 104 to be opened at different locations while keeping other portions of the opening 104 closed. The lid 100 can be partially opened to provide access to the container 102 without complete removal of the lid 100 from the container 102. Partial opening of the lid 100 can be advantageous, for example, if cold items (e.g., drinks and ice) or odorous items (e.g., laundry) are contained inside the container 102, since the lid 100 can provide access to the inside of the container 102 while reducing the amount of cold or odor that escapes, as compared to complete removal of the lid 100. The multiple openable lid portions 112*a* and 112*b* can allow the lid 100 to be opened at multiple different locations or directions without reorienting the container 102. For example, a user can open the first lid portion 112*a* to access the inside of the container 102 from the left side, and a user can open the second lid portion 112*b* to access the inside of the container 102 from the right side, without needing to reorient the container 102, which can be difficult especially when the container holds heavy items.

A junction 114 can couple the first and second lid portions 112*a* and 112*b* to each other. In some embodiments, the first and second lid portions 112*a* and 112*b* can be integrally formed as a single unitary piece, or the first and second lid portions 112*a* and 112*b* can be separate pieces coupled together by the junction 114. The junction 114 can be integrally formed with one or both of the lid portions 112*a* and 112*b*, or the junction 114 can be a separate piece from the first and second lid portions 112*a* and 112*b*. The junction 114 can comprise a joint, such as a hinge, that allows the first and second lid portions 112*a* and 112*b* to move with respect to each other. For example, the junction 114 can enable one or more of the lid portions 112*a* and 112*b* to rotate about an axis 116 (shown in FIG. 1), which can extend along the junction 114. Thus, the lid 100 can pivot (e.g., hinge or fold) along the junction 114, to allow a lid portion 112*a* or 112*b* to open.

In some embodiments, the junction 114 can extend through a generally central portion 118 of the lid 100. The first and second lid portions 112*a* and 112*b* can be substantially the same size, and can provide substantially similar sized openings into the container 102 when opened. Thus, substantially equal levels of access can be provided on multiple sides of the container. In some embodiments, the first and second lid portions 112*a* and 112*b* can be substantially symmetrical on either side of the junction 114. In some embodiments, the junction 114 can intersect a point substantially at the center of the lid 100.

In some embodiments, the container can include handles 120*a* and 120*b*, which can include a length of rope, or a strap, or other bendable material that is configured to provide a gripping surface. The handles 120*a* and 120*b* can extend generally upwardly from the rim 110 that surrounds the opening 104 on the container 102. The rim 110 can include holes through which the rope, or strap, etc. can extend, and a knot or retaining mechanism or widened portion of the rope, or strap, etc. can prevent the handles 120*a* and 120*b* from pulling through the holes (e.g., when a lifting force is applied to the handles 120*a* and 120*b*). Other handle configurations are possible. For example, the handles 120*a* and 120*b* can be substantially rigid members and/or can be integrally formed with the container 102. In some embodiments, the handles 120*a* and 120*b* can be positioned on generally opposite sides of the container 102.

In some embodiments, the lid 100 can extend over at least a portion of the rim 110. The lid 100 can include recesses 122*a* and 122*b* formed at the periphery of the lid 100 and configured to be positioned at the locations of the handles 120*a* and 120*b* so that the handles can extend through the recesses 122*a* and 122*b* when the lid 100 is attached to the container 102. The recesses 122*a* and 122*b* can be formed by removing material from the formed lid 100 or the lid 100 can be formed (e.g., molded) having a shape that includes the recesses 122*a* and 122*b*. In some embodiments, the junction 114 can extend between the recesses 122*a* and 122*b*, for example, such that the lid 100 can pivot (e.g., hinge or fold) at the recesses 122*a* and 122*b*. In some embodiments, the recesses 122*a* and 122*b* can be positioned on generally opposite sides of the lid 100.

In some embodiments, the lid 100 can include lid handles 124*a* and 124*b*, which can provide a gripping surface to facilitate opening of the lid portions 112*a* and 112*b*. The lid handles 124*a* and 124*b* can includes a raised portion that forms a gap between the lid 100 and the rim 110 of the container 102, thereby enabling a user to insert fingers into the gap and pull the lid portion 112*a* or 112*b* upward to disengage the lid portion 112*a* or 112*b* from the container 102. Each lid portion can include a lid handle 124*a* and 124*b*. In some embodiments, the lid handles 124*a* and 124*b* can be positioned on generally opposite sides of the lid 100. In some embodiments, the lid handles 124*a* and 124*b* can be positioned substantially equidistant between recesses 122*a* and 122*b*. In some embodiments, the lid handles 124*a* and 124*b* can be positioned on the sides of the corresponding lid portions 112*a* and 112*b* generally opposite from the junction 114.

Figure 4:
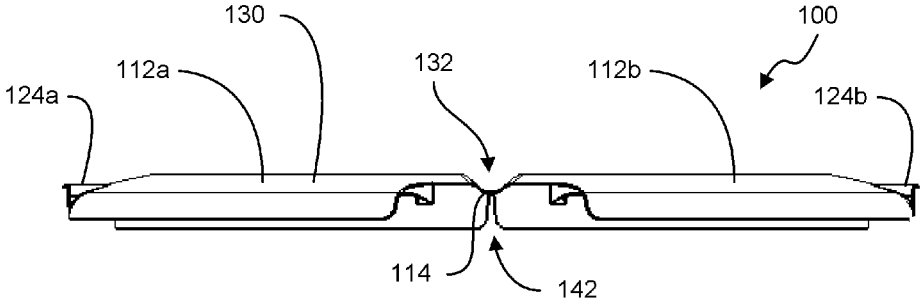
FIG. 4 is a side view of the lid.
Figure 5:
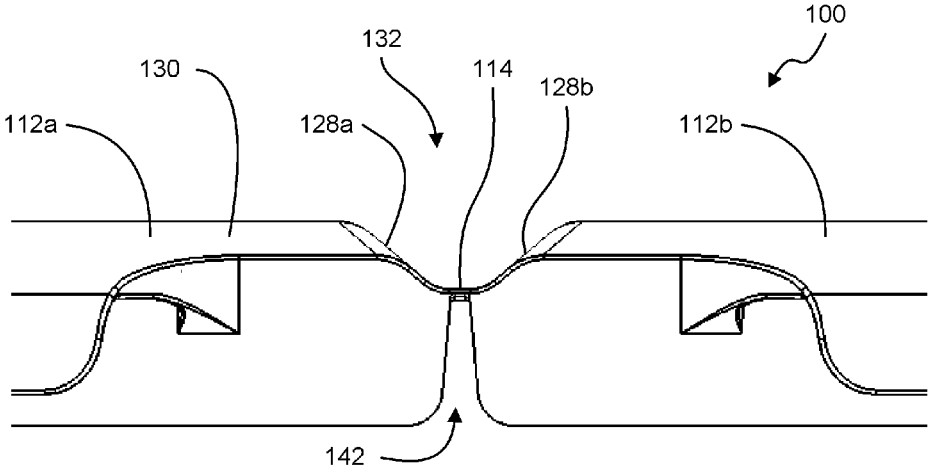
FIG. 5 is a detailed side view showing an area of the lid near the junction.

As shown in FIG. 3, the lid 100 can be configured to prop or otherwise hold the lid portion 112*a* or 112*b* open at an angle 126 of at least about 90° and/or less than or equal to about 150°, although angles outside of these ranges can also be used. In some embodiments, the lid portion 112*a* or 112*b* can be propped open at an angle 126 of about 120°. The lid 100 can include pivot limiter that limits the amount that one or both of the lid portions 112*a* and 112*b* can open, thereby enabling the lid portions 112*a* and 112*b* to be propped open at the angle 126. The pivot limiter can include first and second propping surfaces 128*a* and 128*b*, which can be positioned on opposite sides of the junction 114. FIG. 4 is a side view of the lid 100, and FIG. 5 is a detailed side view showing an area of the lid 100 near the junction 114. As can be seen in FIG. 5, in some embodiments, the propping surfaces 128*a* and 128*b* can be angled away from each other. When the first lid portion 112*a* is opened, the first propping surface 128*a* can pivot along with the lid portion 112*a* until the propping surface 128*a* abuts against the second lid portion 112*b* (e.g., against the second propping surface 128*b*). Similarly, when the second lid portion 112*b* is opened, the second propping surface 128*b* can pivot along with the second lid portion 112*b* until the propping surface 128*b* abuts against the first lid portion 112*a* (e.g., against the first propping surface 128*a*). The propping surfaces 128*a* and 128*b* can be configured to allow the lid portions 112*a* and 112*b* to be propped open at the angle 126, as discussed above.

In some embodiments, the lid 100 can include a raised ridge portion 130 extending around at least a majority (e.g., at least about 50%, 75%, 90%, 95%, or more) of the circumference of the lid 100. The propping surfaces 128*a* and 128*b* can be formed as sides of a recess 132 formed in the ridge 130. In some embodiments, two recesses 132 can be formed (e.g., on generally opposite sides of the lid 100). The recesses 132 can be formed at or near the ends of the fold line through the junction 114. In some embodiments, the recesses 132 can generally align with the recesses 122*a* and 122*b*. The ridge 130 can be formed at or near the periphery or outer perimeter of the lid 100. In some embodiments, the ridge 130 can surround a generally flat inner portion of the lid. In some embodiments, the containers 102 and lids 100 can be stackable. The base 108 of the container 102 can generally fit inside the ridge 130 if one container 102 is stacked on top of the lid 100 of another container 102. The ridge 130 can extend up around at least a portion of the base 108 of the stacked container 102 to prevent the stacked container 102 from sliding off of the lid 100 of the lower container 102. The ridge 130 can be positioned near or abutting the side wall 106 of the stacked container 102 near the base 108.

Figure 6:
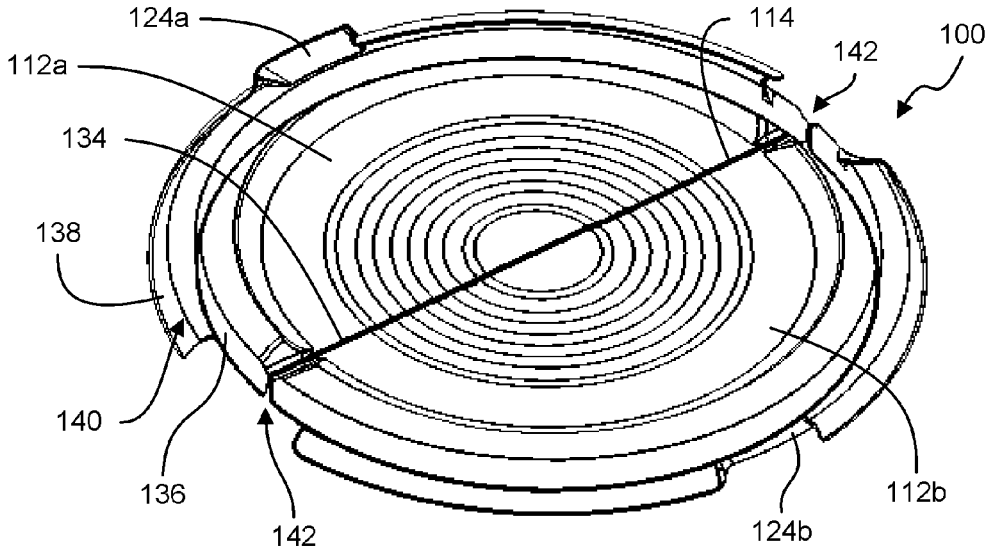
FIG. 6 is a bottom perspective view of the lid.
Figure 7:
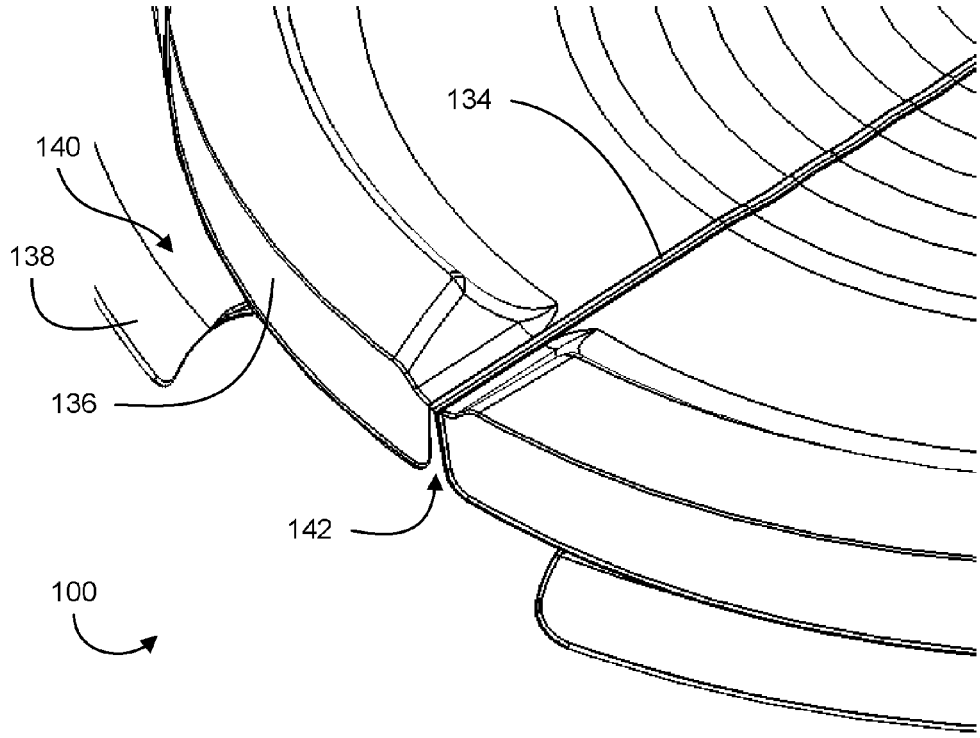
FIG. 7 is a detailed bottom perspective view of an area around the underside of the junction of the lid.

FIG. 6 is a bottom perspective view of the lid 100. FIG. 7 is a detailed perspective view of the area around the underside of the junction 114 of the lid 100. The underside of the lid 100 can include a fold line 134, which can be configured to enable lid 100 to pivot (e.g., hinge or fold) to open the lid portions 112*a* and 112*b*. The fold line 134 can be a groove that extends along the junction 114 forming a bendable portion of the lid 100. The lid 100 portion in the fold line 134 can be thinner than the relatively non-bendable portions of the lid 100, thereby enabling the lid 100 to pivot (e.g., hinge or fold) along the fold line 134 to open the lid portions 112*a* and 112*b*. In some embodiments, the juncture 114 can include a living hinge that allows the lid portions 112*a* and 112*b* to pivot with respect to each other.

Figure 8:
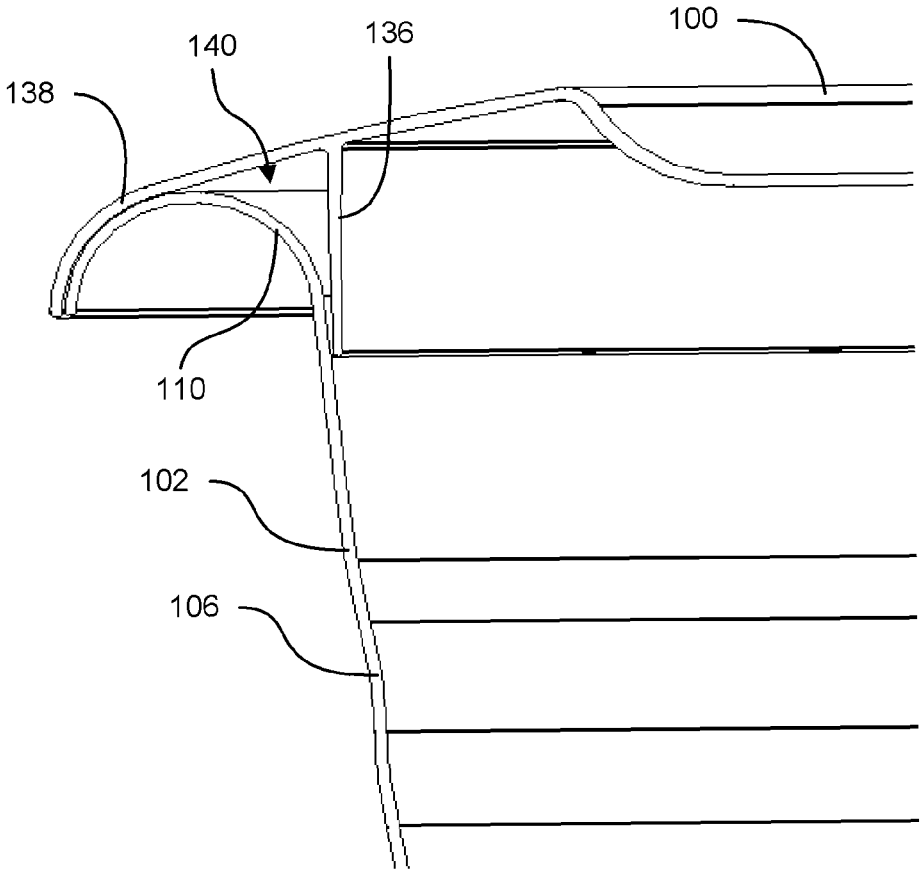
FIG. 8 is a cross-sectional partial view of the lid engaged with the container.

The underside of the lid 100 can be configured to removably attach to the container 102 (e.g., to the rim 110 of the container) using a snap-fit, friction-fit, or other suitable interface. For example, the lid 100 can include an inner engagement wall 136, which can be disposed radially inwardly from an outer engagement wall 138 such that a gap 140 is formed therebetween. The gap 140 can be configured to receive a portion of the container 102 therein to removably attach the lid 100 to the container 102. FIG. 8 is a cross-sectional view of the lid 100 attached to the container 102. The rim 110 can be fit into the gap 140. In some embodiments, the rim 110 can extend radially outwardly further than the side wall 106 of the container 102. When the lid 100 is attached to the container 102, the inner engagement wall 136 can be positioned on a radially inner side of the rim 110, and the outer engagement wall 138 can be positioned on a radially outer side of the rim 110. In some embodiments, the rim 110 can be slightly larger than the gap 140 such that the rim 110 causes one or both of the inner engagement wall 136 and the outer engagement wall 138 to flex when the rim 110 is inserted into the gap 140, thereby providing a retaining force that maintains the lid 100 connected to the container 102, until a sufficient opening force is applied to disengage the rim 110 from the gap 140.

In some embodiments, the rim 110 of the container can have a partially toroidal shape. The rim 110 can be a continuation of the side walls 106 that is curved downward. The outer engagement wall 138 can be curved generally similarly to the lip 110 such that the inner surface of the outer engagement wall 138 abuts against at least a portion of the outer surface of the rim 110 when the lid 100 is attached to the container 102.

As can be seen in FIGS. 6 and 7, the inner engagement wall 136 can include a slit 142 that divides the inner engagement wall 136 at a location generally aligned with the fold line 134. In some embodiments, a plurality of slits 142 can be formed at different sides of the lid 100 (e.g., on generally opposite sides at locations at or near where the fold line 134 meets the inner engagement wall 136). The slits 142 can enable the lid 100 to pivot (e.g., hinge or fold) along the fold line 134. When the lid 100 is opened, the sides of the slits 142 can move apart from each as the slits 142 open. In some embodiments, the outer engagement wall 138 can include slits similar to the slits 142 discussed here. In some embodiments, the outer engagement wall 138 can include the recesses 122*a* and 122*b* that are aligned generally with the fold line 134 to enable pivoting of the lid 100 similar to the slits 142. Thus, the recesses 122*a* and 122*b* can provide space for the handles 120*a* and 120*b* as well as providing a pivoting location on the outer engagement wall 138.

The lid 100 and container 102 can be made from various types of materials. For example, the lid 100 and container 102 can be made from various types of plastics or other polymeric materials. The lid 100 and container 102 can be made using a molding (e.g., injection molding) process, although other suitable manufacturing processes can be used. In some embodiments, the lid 100 can be formed (e.g., by a molding process) as a single, integral piece.

Any features of the embodiments shown an/or described that have not been expressly described, such as distances, proportions of components, etc. are also intended to form part of this disclosure. Also, although the inventions have been described in the context of various embodiments, features, and examples, it will be understood that the inventions extend beyond the specifically disclosed embodiments to other alternative embodiments and modifications and equivalents thereof. Various features of the disclosed embodiments can be combined with, or substituted for, one another to form various alternative embodiments. Thus, various combinations and subcombinations of the disclosed features can be combined.

What is claimed is:

1. A lid for use with a container having an opening, the lid comprising:

a first lid portion configured to releasably attach to a first region of the container to cover a first portion of the opening;

a second lid portion configured to releasably attach to a second region of the container to cover a second portion of the opening;

a junction joining the first lid portion and the second lid portion, the lid configured to pivot at the junction; and one or more recesses in a periphery of the lid, the recesses configured to generally align with one or more handles of the container when the lid is attached to the container such that the one or more handles can pass through the one or more recesses;

wherein the first lid portion, the second lid portion, and the junction are integrally formed as a single piece;

wherein the first lid portion is configured to remain closed on the first region of the container when the second lid portion is open; and wherein the second lid portion is configured to remain closed on the second region of the container when the first lid portion is open.

2. The lid of claim 1, wherein the junction extends generally across a central region of the lid.

3. The lid of claim 2, wherein the junction intersects a point substantially at the center of the lid.

4. The lid of claim 1, wherein the first lid portion and the second lid portion are substantially symmetrical.

5. The lid of claim 1, wherein the junction comprises a groove configured to facilitate pivoting of the lid at the junction.

6. The lid of claim 5, wherein the groove is on an underside of the lid.

7. A container assembly comprising:

the lid of claim 1; and a container configured to releasably attach to the first lid portion and the second lid portion.

8. The lid of claim 1, wherein the lid is configured to prop at least one of the first and second lid portions open at an angle between about 90° and 150°.

9. The lid of claim 1, wherein the lid is configured to prop at least one of the first and second lid portions open at an angle of about 120°.

10. The lid of claim 1, wherein a first recess is positioned at a first end of the junction and a second recess is positioned at a second end of the junction, and wherein the recesses facilitate pivoting of the lid at the junction.

11. The lid of claim 1, further comprising an engagement wall configured to engage a portion of the container to releasably attach the lid to the container, wherein the engagement wall comprises one or more slits configured to facilitate pivoting of the lid at the junction.

12. A method of making a lid for use with a container having an opening, the method comprising:

forming a first lid portion configured to releasably attach to a first region of the container to cover a first portion of the opening;

forming a second lid portion configured to releasably attach to a second region of the container to cover a second portion of the opening; and forming a junction joining the first lid portion and the second lid portion, such that the lid is configured to pivot at the junction;

wherein a periphery of the lid includes one or more recesses configured to generally align with one or more handles of the container when the lid is attached to the container such that the one or more handles can pass through the one or more recesses;

wherein the first lid portion, the second lid portion, and the junction are integrally formed as a single piece;

wherein the first lid portion is configured to remain closed on the first region of the container when the second lid portion is open; and wherein the second lid portion is configured to remain closed on the second region of the container when the first lid portion is open.

13. The method of claim 12, wherein the method comprises forming the junction to generally extend across a central region of the lid.

14. The method of claim 12, wherein the method comprises forming the first and second lid portions to be substantially symmetrical to each other.

15. The method of claim 12, wherein forming the junction comprises forming a groove on an underside of the lid, the groove configured to facilitate pivoting of the lid.

16. The method of claim 12, further comprising:

forming a first recess in the periphery of the lid at a first end of the junction; and forming a second recess in the periphery of the lid at a second end of the junction, such that the first and second recesses are configured to facilitate pivoting of the lid at the junction;

wherein first and second recesses are configured to generally align with first and second handles of the container when the lid is attached to the container such that the first and second handles pass through the first and second recesses.

17. The method of claim 12, further comprising:

forming an engagement wall configured to engage a portion of the container to releasably attach the lid to the container; and forming at least one slit in the engagement wall such that the one or more slits facilitate pivoting of the lid at the junction.

18. The container assembly of claim 7, wherein the container comprises one or more handles that pass through the one or more recesses in the periphery of the lid.

19. The lid of claim 8, wherein the first lid portion comprises a first propping surface and the second lid portion comprises a second propping surface, and wherein the first propping surface contacts the second propping surface when one of the first and second lid portions is opened such that the one of the first and second lid portions is propped open, and wherein the first propping surface, second propping surface, the first lid portion, the second lid portion, and the junction are integrally formed as a single piece.

20. The lid of claim 1, further comprising:

a first lid handle configured to facilitate opening the first lid portion while the second lid portion remains closed; and a second lid handle configured to facilitate opening the second lid portion while the first lid portion remains closed.

21. A method of making a container assembly, the method comprising:

making the lid according to the method of claim 12; and attaching the lid to a container that comprises one or more handles such that the one or more handles pass through the one or more recesses in the periphery of the lid.

22. The method of claim 12, wherein the first lid portion comprises a first propping surface and the second lid portion comprises a second propping surface, and wherein the first propping surface contacts the second propping surface when one of the first and second lid portions is opened such that the one of the first and second lid portions is propped open at an angle between about 90° and about 150°, and wherein the first propping surface, second propping surface, the first lid portion, the second lid portion, and the junction are integrally formed as a single piece.

23. The method of claim 12, further comprising:

forming a first lid handle configured to facilitate opening the first lid portion while the second lid portion remains closed; and forming a second lid handle configured to facilitate opening the second lid portion while the first lid portion remains closed.

* * * * *